US006679932B2

(12) United States Patent
Birler et al.

(10) Patent No.: US 6,679,932 B2
(45) Date of Patent: Jan. 20, 2004

(54) HIGH MACHINABILITY IRON BASE SINTERED ALLOY FOR VALVE SEAT INSERTS

(75) Inventors: Mark Birler, Plymouth, MI (US); Salvator Nigarura, Huber Heights, OH (US); Juan Trasorras, Ann Arbor, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 10/135,817

(22) Filed: Apr. 30, 2002

(65) Prior Publication Data

US 2003/0010153 A1 Jan. 16, 2003

Related U.S. Application Data

(60) Provisional application No. 60/289,715, filed on May 8, 2001.

(51) Int. Cl.[7] ..... B22F 3/12

(52) U.S. Cl. ..... 75/231; 75/246; 75/252; 419/25; 419/38

(58) Field of Search ..... 75/231, 246, 252; 419/27, 25, 38

(56) References Cited

U.S. PATENT DOCUMENTS

| | | | |
|---|---|---|---|
| 4,933,008 | A | 6/1990 | Fujiki et al. |
| 5,188,659 | A | 2/1993 | Purnell |
| 5,462,573 | A | 10/1995 | Baker et al. |
| 5,466,414 | A | 11/1995 | Pettersson |
| 5,859,376 | A | 1/1999 | Ishibashi et al. |
| 5,895,517 | A | 4/1999 | Kawamura et al. |
| 6,082,317 | A | 7/2000 | Takahashi et al. |
| 6,139,598 | A | 10/2000 | Narasimhan et al. |
| 6,139,599 | A | 10/2000 | Takahashi et al. |

*Primary Examiner*—Ngoclan Mai
(74) *Attorney, Agent, or Firm*—Howard & Howard

(57) ABSTRACT

A ferrous sintered valve seat material is made of mixed powders comprising a sinter-hardenable phase and a finely dispersed carbide phase. The powder mixture comprises a sinter-hardening prealloyed powder forming 75 to 90 wt. % of the mixture and a tool steel powder with finely dispersed carbides forming 5 to 25% of the mixture. Machinability additives of MnS, $CaF_2$ or $MoS_2$ types are added in an amount of 1 to 5 wt. %. Improved thermal conductivity is obtained by infiltrating the compact with Cu up to 25 wt. %.

31 Claims, No Drawings

HIGH MACHINABILITY IRON BASE SINTERED ALLOY FOR VALVE SEAT INSERTS

This application claims the benefit of U.S. Provisional Application No. 60/289,715, filed May 8, 2001.

BACKGROUND OF THE INVENTION

This invention relates generally to iron-based sintered alloy compositions used for making valve seat inserts for internal combustion engines. Valve seat inserts (VSI) operate in a highly aggressive environment. Valve seat insert alloys require resistance to abrasion and/or adhesion caused by the mating valve seat surface, resistance to the softening and degradation due to the high operating temperatures and resistance to the corrosion induced degradation caused by the combustion products.

Valve seat inserts are machined after insertion in cylinder heads. The cost of machining valve seat inserts is a major contributor to the overall cost of machining cylinder heads. This poses a major problem to valve seat insert alloy design because the hard material phases that endow the alloy with wear resistance also produce severe wear of cutting tools during the machining operations.

Sintered alloys have displaced cast alloys for valve seat insert for most passenger car engine applications. Powder metallurgy (pressing and sintering) is a very attractive VSI manufacturing process because of its alloying flexibility which enables the coexistence of very dissimilar phases such as carbides, soft ferrite or pearlite phases, hard martensite, Cu-rich phase etc., and its near-net shape capability that reduces machining costs.

Sintered valve seat insert alloys have evolved in response to the demands of internal combustion engines-higher power density that results in higher thermal and mechanical loads, alternative fuels for reduced emissions and longer engine life. Those sintered alloys are primarily of four types:

1) 100% tool steel,
2) Pure iron or low-alloy iron matrix with the addition of particles of a hard phase to increase wear resistance,
3) High carbon, high chromium (>10 wt. %) steels, and
4) Co and Ni base alloys.

These materials have met most of the durability requirements. However, all of them are difficult to machine, in spite of a the use of high percentage of added machinability agents.

Types 1, 2 and 3 are high-carbide-containing materials. U.S. Pat. Nos. 6,139,599, 5,859,376, 6,082,317, 5,895,517 and others describe iron base sintered alloys with hard particles dispersed in a mainly pearlite phase (5 to 100% pearlite) plus isolated fine carbides and self-lubricating compounds for exhaust valve seat applications.

Increasing the amount and size of carbides in the alloy, while increasing durability, is detrimental to processing (compressibility and green strength) and machinability of the finished valve seat insert. In addition, the strength of the sintered product is dramatically reduced by the presence of massive carbides or hard particles.

U.S. Pat. No. 6,139,598 presents a valve seat insert material with a good combination of compressibility, high temperature wear resistance, and machinability. The mixture used to manufacture this material is a complex blend of steel powder containing Cr and Ni (>20% Cr and <10% Ni), Ni powder, Cu, ferroalloy powder, tool steel powder and solid lubricant powder. While this material may bring significant improvements in compressibility and wear resistance, its high content in alloying elements suggests a high material cost (Ni, Tool steel, Cr rich steel powder, ferroalloys).

U.S. Pat. No. 6,082,317 presents a valve seat insert material in which cobalt-based hard particles are dispersed in a matrix of an iron-based alloy. In comparison with conventional hard particles (carbides), cobalt-based hard particles are claimed to be less abrasive, resulting in reduced wear of the mating valve. It is stated that this material is suitable for applications requiring direct contact between the metallic surfaces of the valve and the valve seat, as used in internal combustion engines. Although Co alloys present a good balance of properties, the price of Co makes these alloys too costly for automotive applications.

DETAILED DESCRIPTION

The present invention addresses all the shortcomings listed above by delivering a pressed-and-sintered alloy with superb machinability and high heat and wear resistance.

This invention solves the machinability problem by presenting a unique combination of high strength-low carbon martensitic matrix, fine dispersed carbides, machinability additives and a network of Cu rich phase filling the porosity. The amount of hard particles dispersed in the hard martensitic matrix is relatively small, thus reducing the cost of the alloy.

According to the present invention a sinter-hardening alloy has a matrix comprising: 2 to 5 wt. % Cr; 0 to 3 wt. % Mo; 0 to 2 wt. % Ni and the remainder consists of Fe in which these elements are preferably fully prealloyed. 5 to 25 wt. % tool steel is added to improve wear and heat resistance and at least one of the machinablity additives in the group of MnS; $CaF_2$ or $MoS_2$ in an amount of 1 to 5 wt. %. In order to significantly improve the thermal conductivity, the pores are filled with Cu alloy in an amount of 10 to 25 wt. %, added by means of infiltration of compacts during sintering. Cu infiltration also improves the machinability of the alloy.

In order that the present invention may be more fully understood, key properties are presented and compared to prior typical valve seat insert material properties. The powder blend composition of example materials is presented in Table 1 and the properties are given in Table 2.

TABLE 1

Powder Blend Composition of Example Materials

| Material Identification | Fe or Low alloy steel wt. % | Cu wt. % or Infiltration | Tool Steel; wt. % | C wt. % graphite | Solid Lubricant wt. % |
|---|---|---|---|---|---|
| New Material | 89.25 | Infiltration | 8.5 | 0.75 | 1.5 |
| Alloy A | 49.50 | Infiltration | 49.50 | 0.5 | 0.50 |
| Alloy B | 48.37 | — | 48.37 | 0.26 | 3 |

In Table 1, Fe stands for base powder which is used in the mixture and which is straight iron powder or alloyed steel powder. Tool steel powder stands for the second component of the mixture and it is admixed as tool steel powder of M2 or M3/2 type. Cu is added by infiltration of the compact during sintering; graphite and solid lubricant are added in the mixture as elemental powders.

All the powders are mixed with evaporative lubricant, compacted at 6.8 g/cm$^3$ and sintered at 1120° C. (2050° F.). Thermal treatment was carried out after sintering by tempering in air or nitrogen atmosphere at 550° C.

After processing, critical properties were determined on typical samples of each alloy. Machinability was evaluated by face cutting and plunge cutting of 2000 valve seat inserts manufactured with the example materials. Tool wear was measured every fifty cuts. Wear plotted vs. number of cuts and a linear regression analysis was performed. The slope of the regression line indicates the wear rate and was reported as a machinability criterion. In addition, the scar depth on the insert flank cutting edge was measured at the end of each machinability test. Scar depths were also reported as an indication of the machinability of the tested materials.

A measure of the alloy hot wear resistance was obtained in a high temperature sliding wear rig. Ground rectangular bars of the test materials were fixed and an alumina ball was slid with a reciprocating motion on the ground flat surface of the samples. The test samples were maintained at 450° C. during the test. The scar depth is indicative of the sample wear resistance at these conditions.

Hot hardness was measured at different sample temperatures by recording at least five readings at the same temperature and averaging the results.

Thermal conductivity values were calculated by multiplying the measured values of specific heat capacity, thermal diffusivity and density at a given temperature.

Table 2 summarizes the properties of the new material as compared to existing valve seat insert materials containing more than 5 times as much tool steel in their composition. The invented material ("New Alloy") machines 2.5 to 3.7 times better than the example materials with same hot wear resistance and very comparable hot hardness resistance.

TABLE 2

Properties of Example Materials

| Property | | New Alloy | Valve Seat Material A | Valve Seat Material B |
|---|---|---|---|---|
| Compressibility (green Density @ 50 tsi); g/cm$^3$ | | 6.89 | 6.79 | 6.86 |
| Machinability | Average Wear Rate($\mu$m/Cut) | 8.31E-5 | 7.00E-4 | 4.19E-3 |
| | Average Wear Scar Depth ($\mu$m) | 38 | 95 | 142 |
| Wear Resistance (Average Wear Scar Volume after Hot Wear Test); mm$^3$ | | 6.29 | 2.71 | 6.51 |
| Thermal Conductivity | Wm$^{-1}$K$^{-1}$ @ RT | 42 | 46 | 32 |
| | Wm$^{-1}$K$^{-}$@ 300° C. | 41 | 46 | 27 |
| | Wm$^{-1}$K$^{-}$@ 500° C. | 41 | 44 | 23 |
| Hot Hardness | HR30N @ RT | 55 | 66 | 49 |
| | HR30N @ 300° C. | 50 | 62 | 47 |
| | HR30N @ 500° C. | 39 | 58 | 41 |

Considering that maximum expected operation temperature for an exhaust valve seat insert is approximately 350° C., the results presented in Table 2 demonstrate clearly that the new material will perform better than valve seat Material B and almost as well as valve seat Material A while displaying much higher machinability than Material A. The combined effects of machinability, cost, thermal conductivity and wear resistance make this material an ideal replacement of costly products for engine application as valve seat insert material.

Obviously, many modifications and variations of the present invention are possible in light of the above teachings. It is, therefore, to be understood that within the scope of the appended claims, the invention may be practiced otherwise than as specifically described. The invention is defined by the claims.

What is claimed is:

1. A sinter-hardenable powder metal valve seat material for internal combustion engines comprising a mixture of:

a sinter-hardenable ferrous powder forming 75–90 wt. % of the mixture;

a tool steel powder;

a solid lubricant;

Cu added by infiltration during sintering, and wherein the ferrous powder is prealloyed with 2 to 5 wt. % Cr.

2. The material of claim 1 wherein the tool steel is mixed in proportions of 5 to 25 wt. %.

3. The material of claim 1 wherein the tool steel is selected from the group consisting of M2 and M3/2 tool steel.

4. The material of claim 1 wherein the tool steel consists of M2 tool steel.

5. The material of claim 1 wherein the ferrous powder is further prealloyed with 0 to 3 wt. % Mo and 0 to 2 wt. % Ni.

6. The material of claim 1 having the following composition:

75 to 90% of the ferrous powder prealloyed with 2 to 5 wt. % Cr, 0 to 3 wt. % Mo and 0 to 2 wt. % Ni;

5 to 25 wt. % M2 tool steel powder;

1 to 5 wt. % of the solid lubricant selected from one or more of the group consisting of MnS, $CaF_2$ and $MoS_2$; and the Cu added by infiltration during sintering amounting to 10 to 25 wt. % of the remaining constituents.

7. The mixture of claim 6 wherein the ferrous powder is present in an amount of 89 wt. %.

8. The mixture of claim 6 wherein the M2 tool steel is present in an amount of 8 wt. %.

9. The mixture of claim 6 wherein the solid lubricant is present in an amount of 3 wt. %.

10. The mixture of claim 6 wherein the Cu is present in an amount of 20 wt. % of the remaining constituents of the mixture.

11. The mixture of claim 6 having the following composition:

89 wt. % of the ferrous powder;

8 wt. % of the M2 tool steel;

3 wt. % of the solid lubricant; and 20 wt. % infiltrated Cu relating to the combined weight percentage of the ferrous powder, M2 tool steel and solid lubricant.

12. A sintered valve seat insert material for internal combustion engines with improved machinability, wear resistance and high thermal conductivity, where said material consists of a mixture of a Cr-containing sinter-hardening ferrous alloy powder, a tool steel powder, a solid lubricant and Cu added by infiltration of compacts during sintering.

13. The material according to claim 12, characterized in that the microstructure is fully martensitic after sintering in a conventional furnace without accelerated cooling.

14. The material according to claim 12, characterized in that the tool steel is mixed in proportions of 5 to 25% only in the mixture.

15. The material according to claim 12, characterized by the following mixture composition:

75 to 90% of a sinter-hardening iron powder prealloyed with;

2 to 5 wt. % Cr; 0 to 2 wt. % Ni; 0 to 3 wt. % Mo 5 to 25 wt. % M2 tool steel powder;

1 to 5 wt. % solid lubricant selected from the group consisting of MnS, $CaF_2$ and $MoS_2$;

10 to 25 wt. % of Cu added by infiltration of solid blanks during sintering.

16. A sintered valve seat insert for internal combustion engines exhibiting good machinability, wear resistance and high thermal conductivity, comprising:

a matrix of a sinter-hardening prealloyed or admixed Fe powder containing 2 to 5 wt. % Cr mixed and sintered with an amount of tool steel powder, a solid lubricant and an amount of Cu added by infiltration during sintering.

17. The sintered valve seat insert of claim 16 having a micro structure which is fully martensitic after sintering without accelerated cooling.

18. The sintered valve seat of claim 16 wherein the tool steel is mixed in proportions of 5 to 25 wt. %.

19. The sintered valve seat of claim 16 wherein the Fe powder further includes 0 to 3 wt. % Mo and 0 to 2 wt. % Ni.

20. The sintered valve seat of claim 19 wherein the tool steel comprises M2 tool steel present in an amount of 5 to 25 wt. %.

21. The sintered valve seat of claim 20 wherein the tool steel is present in an amount of 8 wt. %.

22. The sintered valve seat of claim 19 wherein the solid lubricant is selected from one or more of the group consisting of MnS, $CaF_2$ and $MoS_2$ and is present in an amount of 1 to 5 wt. %.

23. The sintered valve seat of claim 22 wherein the solid lubricant is present in an amount of 3 wt. %.

24. The sintered valve seat of claim 19 wherein the Cu is infiltrated in an amount of 10 to 25 wt. % of the other constituents of the mixture.

25. The sintered valve seat of claim 24 wherein the Cu is infiltrated in an amount of 20 wt. %.

26. A method of making a sintered powder metal valve seat insert for internal combustion engines exhibiting good machinability, wear resistance and high thermal conductivity, comprising:

mixing Cr-containing sinter-hardenable ferrous powder with tool steel powder and a solid lubricant;

compacting and sintering the mixture; and during sintering, infiltrating the compact with Cu.

27. The method of claim 26, wherein a fully martensite micro structure results by allowing the sintered compact to cool following sintering without quenching.

28. The method of claim 26 wherein the tool steel is added in an amount of 5 to 25 wt. %.

29. The method of claim 26 wherein the mixture is prepared from the following composition:

75 to 90 wt. % of the Cr-containing ferrous powder;

5 to 25 wt. % of M2 tool steel;

1 to 5 wt. % of the solid lubricant; and wherein the Cu is infiltrated into the compacted mixture in an amount of 10 to 25 wt. % of the compact.

30. The method of claim 29 wherein the Cr-containing ferrous powder comprises elemental admixed or prealloyed Fe powder combined with 2 to 5 wt. % Cr, 0 to 3 wt. % Mo and 0 to 2 wt. % of Ni.

31. The method of claim 30 wherein the Cr-containing ferrous powder is present in an amount of 89 wt. %, the M2 tool steel present in an amount of 8 wt. %, the solid lubricant present in an amount of 3 wt. %, and the Cu infiltrated in an amount of 20 wt. % of the compact during sintering.

* * * * *

UNITED STATES PATENT AND TRADEMARK OFFICE

CERTIFICATE OF CORRECTION

PATENT NO. : 6,679,932 B2 
DATED : January 20, 2004
INVENTOR(S) : Mark Birler, Salvator Nigarura and Juan Trasorras It is certified that error appears in the above-identified patent and that said Letters Patent is hereby corrected as shown below:

Column 5,
Line 18, please delete “micro structure” and insert therein -- microstructure --.

Column 6,
Line 28, please delete “micro structure” and insert therein -- microstructure --.

Signed and Sealed this

Ninth Day of March, 2004

JON W. DUDAS
*Acting Director of the United States Patent and Trademark Office*